US007750785B2

(12) United States Patent
Chen et al.

(10) Patent No.: US 7,750,785 B2
(45) Date of Patent: Jul. 6, 2010

(54) COIL FRAME CAPABLE OF CONNECTING WITH ANOTHER COIL FRAME

(75) Inventors: Wen-Sheng Chen, Taipei (TW); Chun-Hung Lin, Taipei County (TW)

(73) Assignee: Lite-On Technology Corp., Taipei (TW)

( * ) Notice: Subject to any disclaimer, the term of this patent is extended or adjusted under 35 U.S.C. 154(b) by 634 days.

(21) Appl. No.: 11/695,060

(22) Filed: Apr. 2, 2007

(65) Prior Publication Data

US 2007/0290781 A1 Dec. 20, 2007

(30) Foreign Application Priority Data

Jun. 14, 2006 (TW) ..... 95210375 U

(51) Int. Cl.
*H01F 27/28* (2006.01)
*H01F 27/30* (2006.01)

(52) U.S. Cl. ..... 336/180; 336/182; 336/185; 336/198

(58) Field of Classification Search ..... 336/182, 336/185, 196–198, 180
See application file for complete search history.

(56) References Cited

U.S. PATENT DOCUMENTS 7,154,366 B2 * 12/2006 Hsueh et al. ..... 336/198

FOREIGN PATENT DOCUMENTS

JP 04304602 A * 10/1992

* cited by examiner

*Primary Examiner*—Ramon M Barrera
(74) *Attorney, Agent, or Firm*—Rosenberg, Klein & Lee

(57) ABSTRACT

Coil frames and transformers are provided. A coil frame includes a sub-coil-frame and an extended frame. The sub-coil-frame is utilized for winding a metal coil thereon. The extended frame is attached to the sub-coil-frame. The extended frame has a hole and a protrusion. The hole of the coil frame can be connected with the protrusion of another coil frame.

15 Claims, 9 Drawing Sheets

COIL FRAME CAPABLE OF CONNECTING WITH ANOTHER COIL FRAME

BACKGROUND OF THE INVENTION

1. Field of the Invention

The present invention relates to a coil frame, and more particularly, to a coil frame capable of connecting with another coil frame.

2. Description of the Prior Art

As decreased price and increased quality of liquid crystal displays (LCD) becomes a market trend, LCD displays are now widely used in electronic devices, such as notebook computers, personal digital assistants (PDA), mobile phones, monitors, and flat-panel televisions. LCD displays are passive lighting type flat-panel displays, so they require backlight modules to supply light to the LCD displays.

Typically, light generating devices in backlight modules are cold cathode fluorescent lamps (CCFL), external electrode fluorescent lamps (EEFL), or light emitting diodes (LED). Based on the locations of light generating devices, backlight modules can be categorized into two kinds: direct lighting type backlight modules and edge lighting type backlight modules. In a direct lighting type backlight module, a light generating device is disposed immediately below a display panel, so direct lighting type backlight modules are appropriate for display panels with high brightness requirements or large sized display panels, for example, computer monitors or flat-panel televisions. In an edge lighting type backlight module, a light-generating device is disposed near lateral sides of a display panel, so volume and production costs of LCD displays can be greatly decreased. Therefore, edge lighting type backlight modules are appropriate for small sized electronic devices.

Large sized LCD displays usually utilize direct lighting type multiple tube systems, requiring multiple transformers to drive the tubes. Please refer to FIG. 1. FIG. 1 is a schematic view of a transformer 1 according to the prior art. The transformer 1 comprises a coil frame 10 and two E-shaped cores 11 and 12. The coil frame 10 comprises a primary sub-coil-frame 14 and a secondary sub-coil-frame 13. Metal coils are wound on the primary sub-coil-frame 14 and the secondary sub-coil-frame 13 to form a primary coil and a secondary coil respectively. When an electrical current is supplied to the primary coil 14, magnetism induced by the electrical current forms a closed loop by physical contact of the two E-shaped cores 11 and 12. The transformer 1 in FIG. 1, however, can drive only one tube. In other words, the number of transformers has to be increased in order to drive more than one tube. In such a case, volume and production costs of LCD displays is greatly increased.

Please refer to FIG. 2. FIG. 2 is a schematic view of a transformer 2 of the prior art. The transformer 2 comprises a coil frame 20 and two E-shaped cores 21 and 22. The coil frame 10 comprises a primary sub-coil-frame 24 and two secondary sub-coil-frames 23 and 25. Metal coils are wound on the primary sub-coil-frame 24 and the secondary sub-coil-frames 23 and 25 to form a primary coil and two secondary coils respectively. Unlike the transformer 1 in FIG. 1, the transformer 2 in FIG. 2 can drive two tubes simultaneously. Moreover, volume of the transformer 2 is far less than a combined volume of two transformers 1. The transformer 2 is restricted by the shape of its core, however, and is thus limited in application.

SUMMARY OF THE INVENTION

The present invention provides a coil frame, comprising: a sub-coil-frame, for winding a metal coil thereon; and an extended frame, attached to the sub-coil-frame and having a hole and a protrusion, wherein the hole of the coil frame can be connected with the protrusion of another coil frame.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
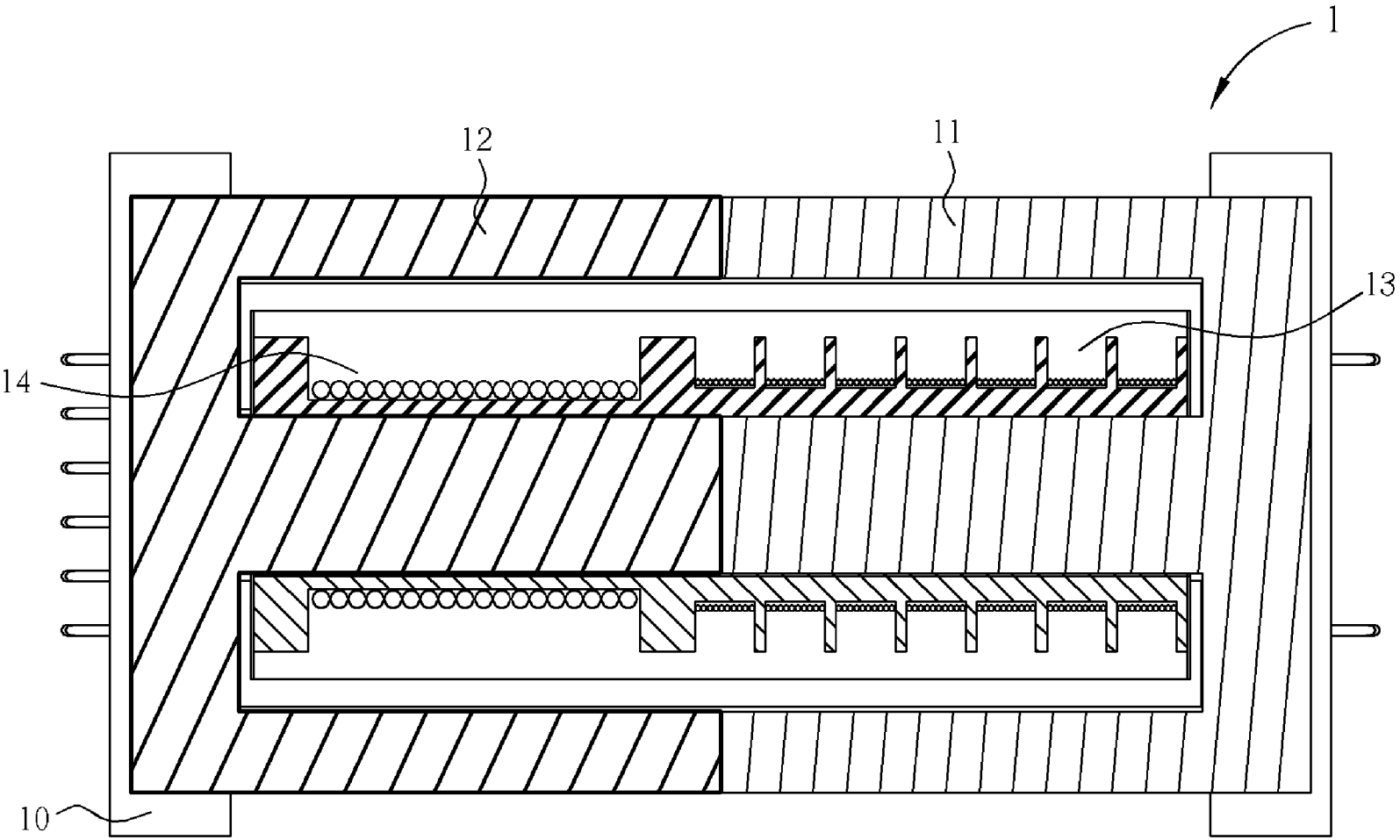
Fig. 1 Prior Art
FIGS. 1-2 are schematic views of transformers according to the prior art.
Figure 2:
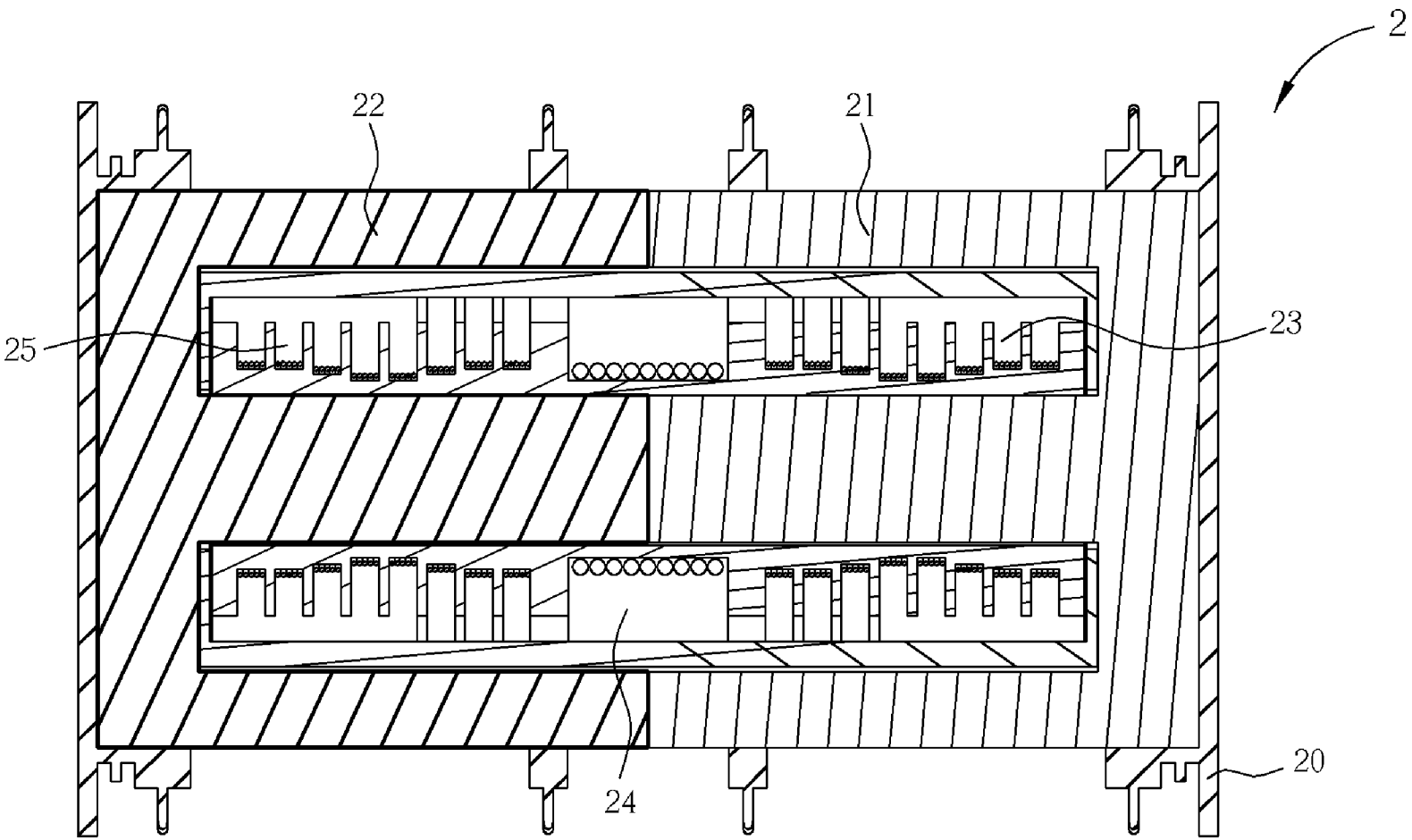
Fig. 2 Prior Art
Figure 3:
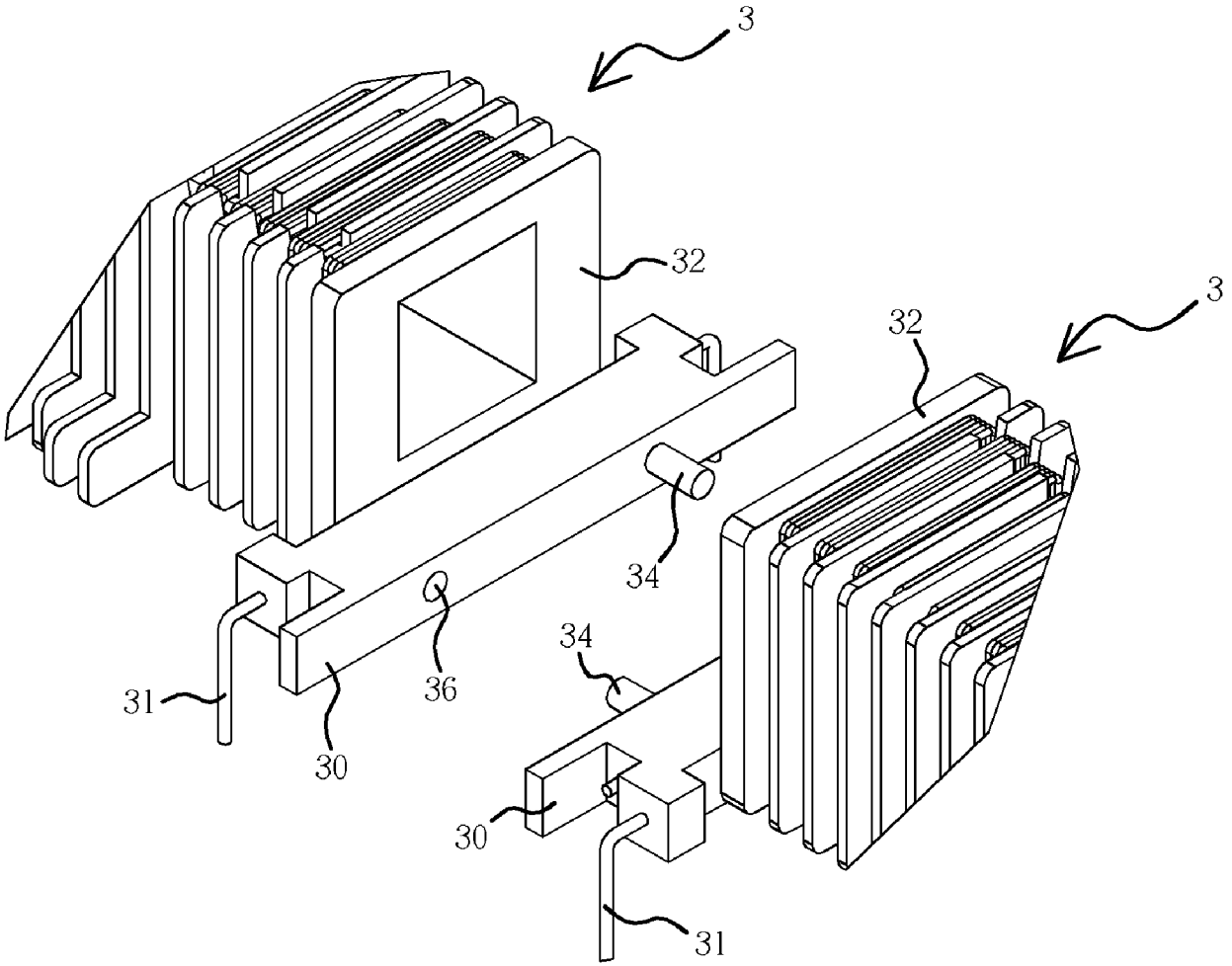
FIG. 3 is a schematic view of a coil frame of the present invention.

Please refer to FIG. 3. FIG. 3 is a schematic view of a coil frame 3 of the present invention. The coil frame 3 comprises a sub-coil-frame 32 and an extended frame 30. The sub-coil-frame 32 comprises a primary sub-coil-frame and a secondary sub-coil-frame. Metal coils are wound on the primary sub-coil-frame and the secondary sub-coil-frame to form a primary coil and a secondary coil respectively. The coil frame 3 further comprises a metal pin 31, coupled to the metal coils. The number of the primary sub-coil-frame and the secondary sub-coil-frame may vary according to the application. The extended frame 30 is attached to the sub-coil-frame 32. The extended frame 30 has a hole 36 and a protrusion 34. The protrusion 34 of one coil frame 3 can be inserted into and engaged with the hole 36 of another identical coil frame 3, thereby connecting the two coil frames 3 together.

The extended frame 30 of the coil frame 3 is designed to have combining components disposed thereon, such as the protrusion 34 and the hole 36 in FIG. 3, to enhance a transformer. The combining components of the extended frame 30 can be of any type or style and are not limited to be the protrusion 34 and the hole 36 in FIG. 3. Any other combining component having the same function is encompassed by the scope of the present invention.

Figure 4:
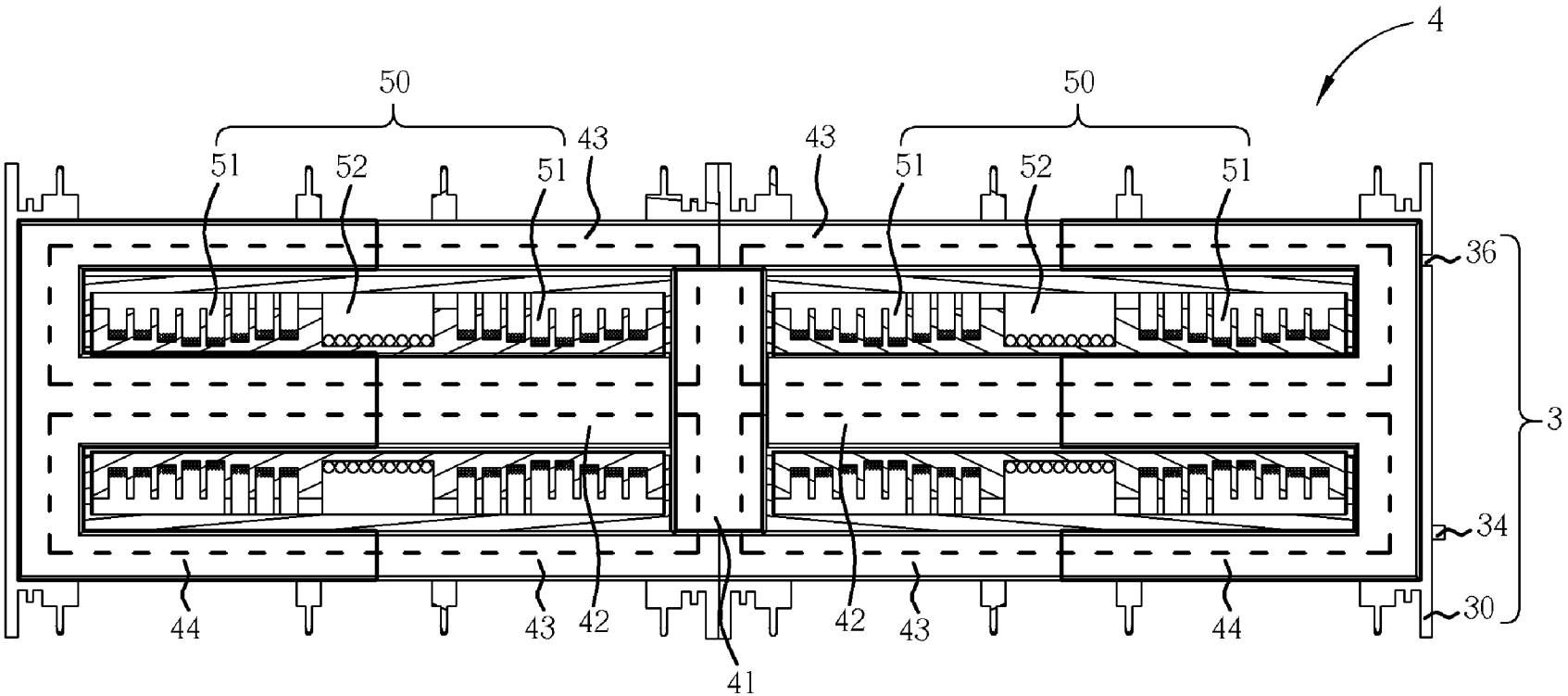
FIG. 4 is a schematic view of a transformer of the present invention.

Please refer to FIG. 4. FIG. 4 is a schematic view of a transformer 4 of the present invention. The transformer 4 comprises the coil frame 3 shown in FIG. 3. In this embodiment, however, the coil frame 3 comprises two sets of sub-coil-frames 50. Each set of sub-coil-frame 50 comprises a primary sub-coil-frame 52 and two secondary sub-coil-frames 51. The primary sub-coil-frame 52 and the secondary sub-coil-frame 51 both comprise a plurality of slots. The slots are designed to resist high voltage and decrease stray capacitance between metal coils. Moreover, metal coils are wound on the primary sub-coil-frame 52 and the secondary sub-coil-frames 51 to form a primary coil and two secondary coils. In this embodiment, the transformer 4 further comprises two coil sets. Each coil set comprises a primary coil and two secondary coils.

Figure 5:
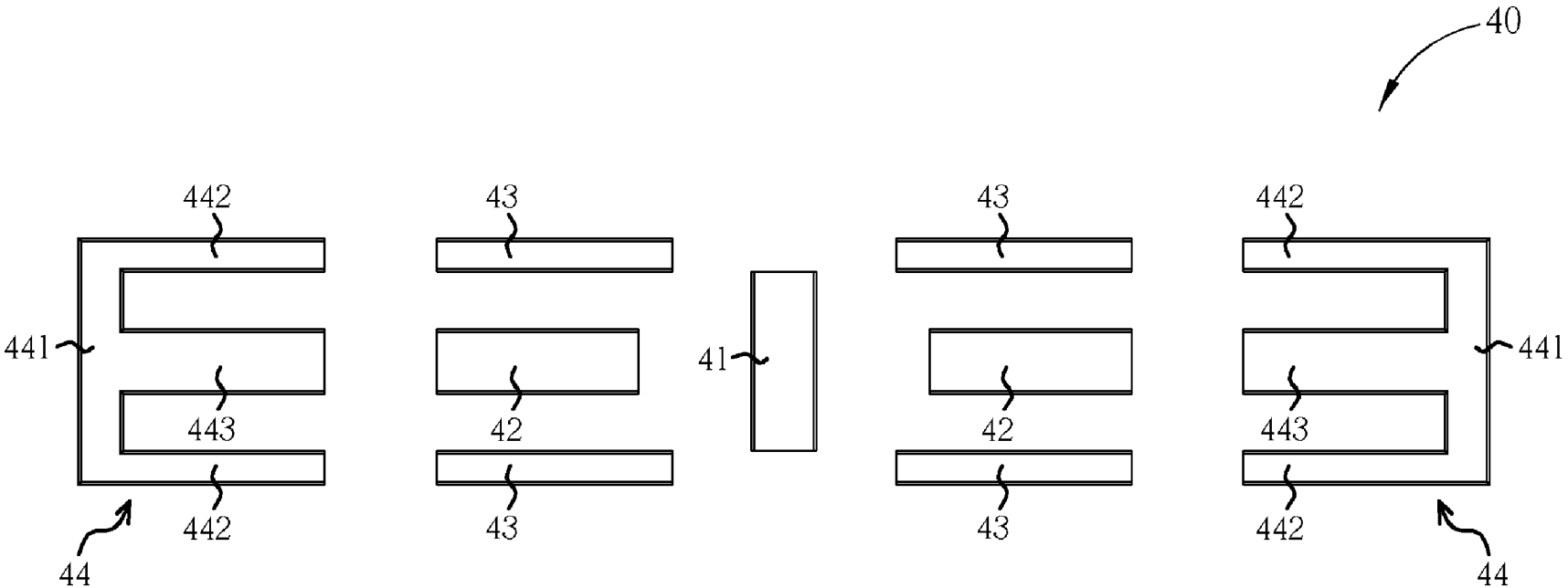
FIG. 5 is a schematic view of a core set in FIG. 4.

The transformer 4 further comprises a core set 40. Please refer to FIG. 5. FIG. 5 is a schematic view of the core set 40 in FIG. 4. The core set 40 comprises a first I-shaped core 41, two second I-shaped cores 42, four third I-shaped cores 43, and two E-shaped cores 44. The first I-shaped core 41 is disposed between the two sets of sub-coil-frames 50 of the coil frame 3 and perpendicular to a through hole of the coil frame 3. The two second I-shaped cores 42 are disposed in the through hole of the coil frame 3, and one end of each second I-shaped core 42 contacts with the first I-shaped core 41. The four third I-shaped cores 43 are disposed at exterior sides of the two sets of sub-coil-frames 50 of the coil frame 3 respectively and contact with the first I-shaped core 41. The two E-shaped cores 44 are disposed at two ends of the coil frame 3 respectively and contact with the two second I-shaped cores 42 and the four third I-shaped cores 43. Each E-shaped core 44 comprises a first sub-core 441, two second sub-cores 442, and a third sub-core 443. The third sub-core 443 is perpendicular to the first sub-core 441 and parallel with the two second sub-cores 442. The third sub-core 443 is between the two second sub-cores 442.

Please refer to FIG. 4 again. When an electrical current is supplied to the primary coil, magnetism induced by the electrical current forms closed loops through the first I-shaped core, the two second I-shaped cores, the two E-shaped cores, and the four third I-shaped cores, as shown by the dotted lines.

Moreover, the width and thickness of each second sub-core 442 of each E-shaped core 44 and that of each third I-shaped core 43 are the same. The width and thickness of the third sub-core 443 of each E-shaped core 44 and that of each second I-shaped core 42 are the same. The width of each second I-shaped core 42 must be greater than that of each third I-shaped core 43. The width of the third sub-core 443 of each E-shaped core 44 must be greater than that of each second sub-core 442 of each E-shaped core 44. For example, the width of the third sub-core 443 of each E-shaped core 44 can be twice the width of each second sub-core 442 of each E-shaped core 44. When an electrical current is supplied to the primary coil, magnetism induced by the electrical current forms two closed loops in each sub-coil-frame 50, as shown by dotted lines in FIG. 4. Both closed loops will pass cores in the through hole of the coil frame 3, so the width of the third sub-core 443 of each E-shaped core 44 and that of each second I-shaped core 42 must be sufficiently large.

Figure 6:
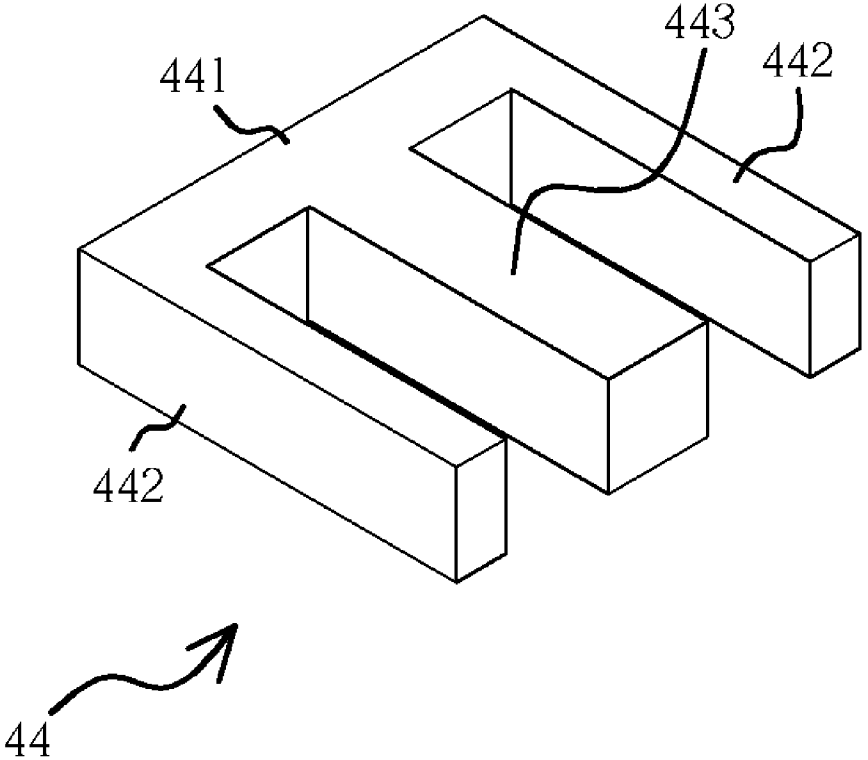
FIGS. 6-7 are schematic views of E-shaped cores according to different embodiments of the present invention in FIG. 4.
Figure 7:
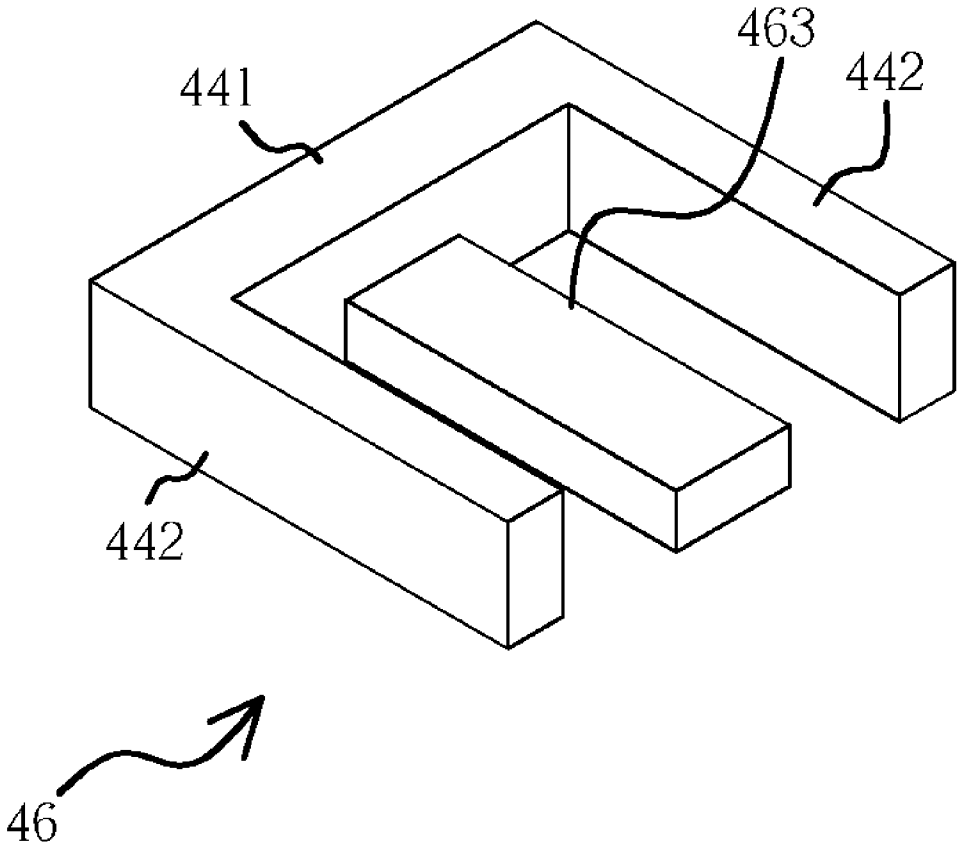

The thickness of the third sub-core 443 of each E-shaped core 44 may be less than or equal to that of the first sub-core 441 of each E-shaped core 44. Please refer to FIGS. 6-7. FIG. 6 is a schematic view of the E-shaped core 44 in FIG. 4. FIG. 7 is a schematic view of another E-shaped core 46. In the embodiment shown in FIG. 6, the thickness of the third sub-core 443 of each E-shaped core 44 is equal to that of the first sub-core 441 of each E-shaped core 44. In the embodiment shown in FIG. 7, the thickness of the third sub-core 463 of each E-shaped core 46 is less than that of the first sub-core 441 of each E-shaped core 46.

Figure 8:
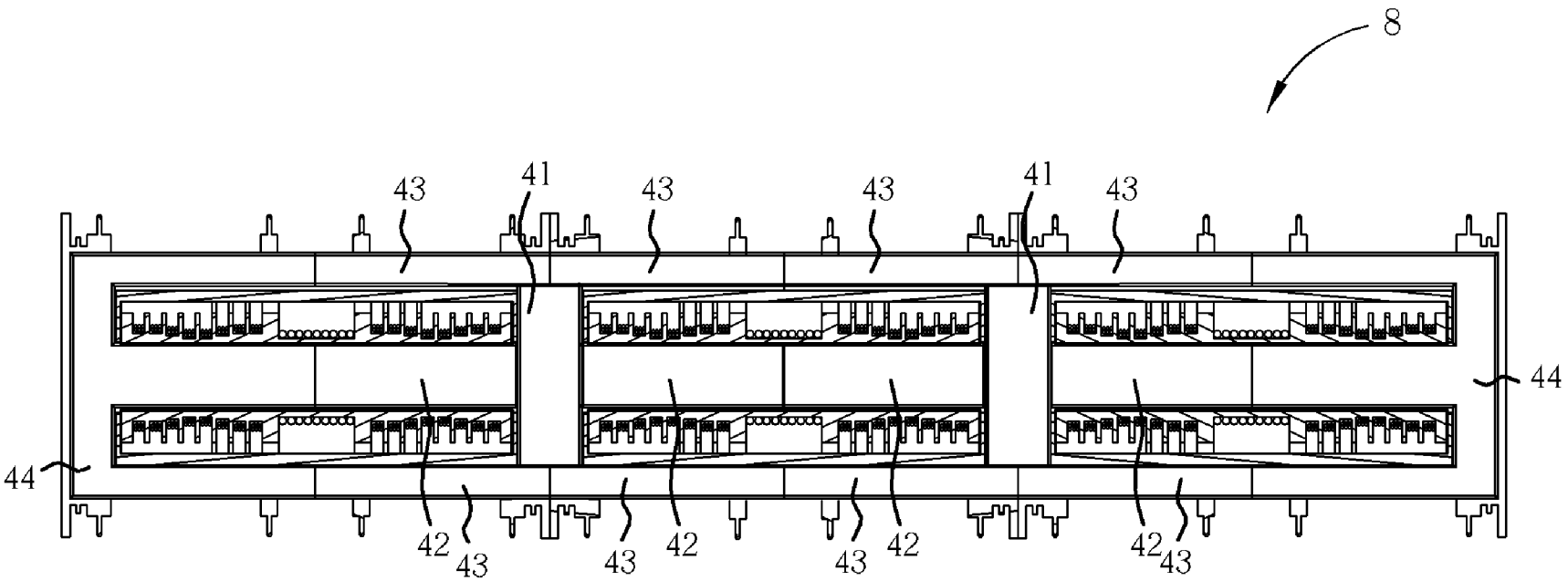
FIG. 8 is a schematic view of another transformer of the present invention.

Based on the arrangement style of the core set 40 in FIG. 5 and multiple types of cores as mentioned above, the transformer 4 of the present invention can be enabled to have more coil sets, thus achieving the goals of driving multiple tubes simultaneously by a single transformer, and decreasing production costs. Please refer to FIG. 8. FIG. 8 is a schematic view of an enhanced transformer 8. The transformer 8 comprises three coil sets. The transformer 8 comprises two E-shaped cores 44, two first I-shaped cores 41, four second I-shaped cores 42, and eight third I-shaped cores 43. Each coil set is separated by a first I-shaped core 41. If the number of tubes is further increased, the transformer can still be enhanced to have even more coil sets, utilizing the above-mentioned method. Moreover, each first I-shaped core 41, each second I-shaped core 42, each third I-shaped core 43, and each E-shaped core 44 in the transformers 4 and 8 respectively contain the same magnetic material.

Figure 9:
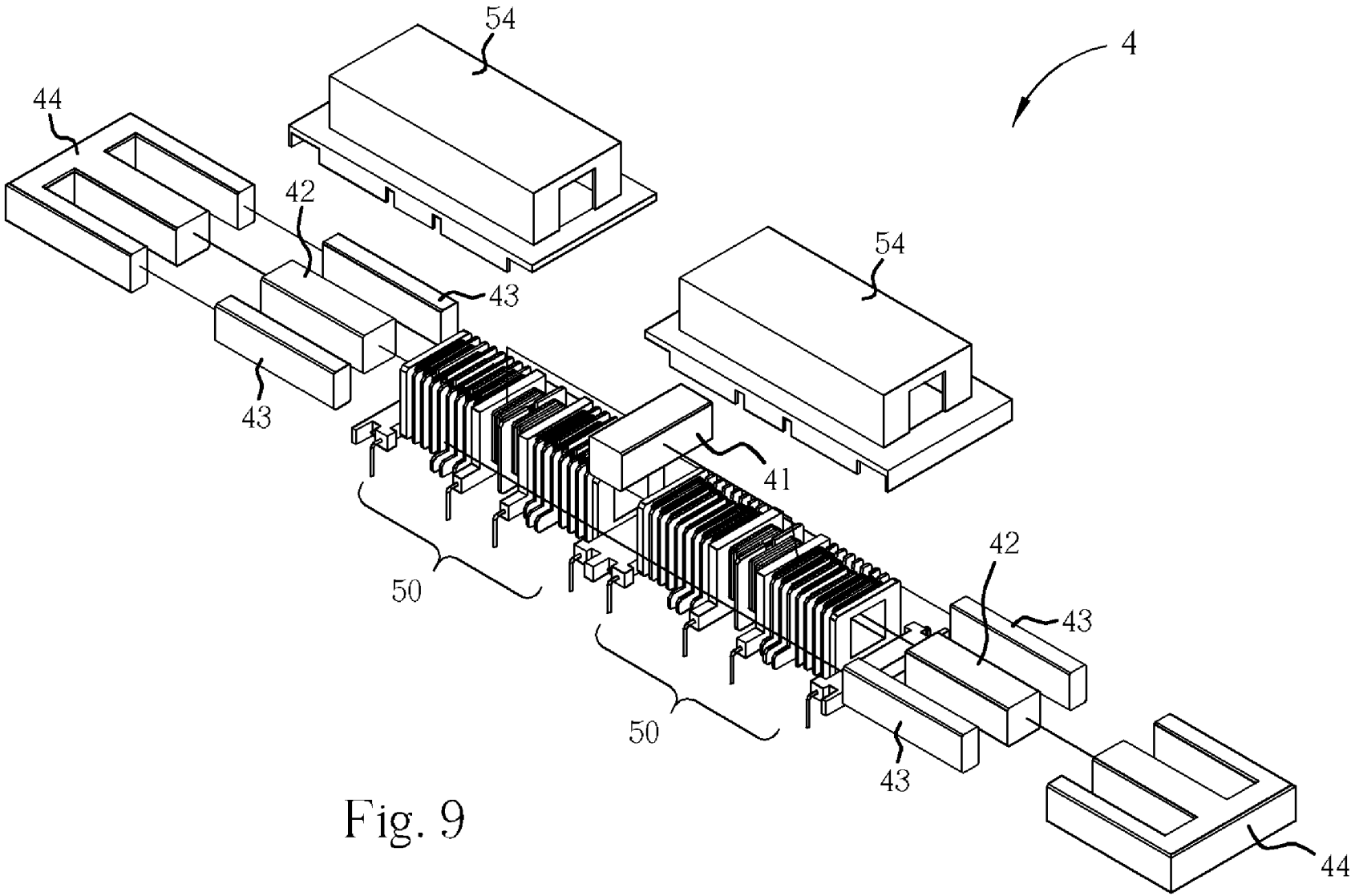
FIG. 9 is an explosive view of the transformer in FIG. 4.

Please refer to FIG. 9. FIG. 9 is an explosive view of the transformer 4 in FIG. 4. The transformer 4 further comprises two covers 54, disposed outside the two sets of sub-coil-frames 50 respectively for supporting the third I-shaped cores 43. During the assembling process, metal coils are first wound on the primary sub-coil-frame 52 and the secondary sub-coil-frames 51 of the coil frame 3, and then the covers 54 are used to cover the two coil sets respectively. Finally, the location of each type of core is adjusted and further held by an adhesive.

No matter how cores in a transformer are combined, the coil frame of the present invention as shown in FIG. 3 can be utilized to enable the transformer to have more coil sets. Based on the arrangement style of the core set and multiple types of cores, the transformer of the present invention can be enhanced to drive multiple tubes simultaneously, thus decreasing production costs of LCD displays when the transformer is utilized in the LCD displays.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A transformer, comprising:

a coil frame, comprising:

a sub-coil-frame, for winding a metal coil thereon, wherein the sub-coil-frame comprises two sets of sub-coil-frames, each set of sub-coil-frames comprises a primary sub-coil-frame and two secondary sub-coil-frames, and each primary sub-coil-frame is disposed between the two secondary sub-coil-frames of the same set; and an extended frame, attached to the sub-coil-frame and having a hole and a protrusion, wherein the hole of the coil frame can be connected with the protrusion of another coil frame; and a core set, partially passing through a through hole of the sub-coil-frame.

2. The transformer of claim 1, wherein a metal pin is disposed on the extended frame, and the metal pin is coupled to the metal coil.

3. The transformer of claim 1, wherein the sub-coil-frame is a primary sub-coil-frame, and the coil frame further comprises a secondary sub-coil-frame adjacent to the primary sub-coil-frame.

4. The transformer of claim 1, wherein the sub-coil-frame is a secondary sub-coil-frame, and the coil frame further comprises a primary sub-coil-frame adjacent to the secondary sub-coil-frame.

5. The transformer of claim 1, wherein the secondary sub-coil-frame comprises a plurality of slots.

6. The transformer of claim 1, wherein the primary sub-coil-frame comprises a plurality of slots.

7. The transformer of claim 1, further comprising two coil sets, wherein each coil set comprises a primary coil and two secondary coils, each primary coil is wound on a corresponding primary sub-coil-frame, and each secondary coil is wound on a corresponding secondary sub-coil-frame.

8. The transformer of claim 7, wherein the core set comprises:

a first I-shaped core, perpendicular to the through hole of the coil frame and disposed between the two sets of sub-coil-frames of the coil frame;

two second I-shaped cores, disposed in the through hole of the coil frame and contacting with the first I-shaped core;

two E-shaped cores, disposed at two ends of the coil frame respectively and contacting with the two second I-shaped cores, wherein each E-shaped core comprises a first sub-core, two second sub-cores, and a third sub-core, the third sub-core is perpendicular to the first sub-core and parallel with the two second sub-cores, and the third sub-core is between the two second sub-cores; and four third I-shaped cores, disposed at exterior sides of the two sets of sub-coil-frames of the coil frame respectively and contacting with the two E-shaped cores and the first I-shaped core;

wherein when an electrical current is supplied to the primary coil, magnetism induced by the electrical current forms a closed loop through the first I-shaped core, the two second I-shaped cores, the two E-shaped cores, and the four third I-shaped cores.

9. The transformer of claim 8, further comprising two covers, disposed outside the two sets of sub-coil-frames respectively for supporting the third I-shaped cores.

10. The transformer of claim 8, wherein a width and a thickness of each second sub-core of each E-shaped core and that of each third I-shaped core are the same.

11. The transformer of claim 8, wherein a width of the third sub-core of each E-shaped core is greater than that of each second sub-core of each E-shaped core.

12. The transformer of claim 8, wherein a width and a thickness of the third sub-core of each E-shaped core and that of each second I-shaped core are the same.

13. The transformer of claim 8, wherein a thickness of the third sub-core of each E-shaped core is less than or equal to that of the first sub-core of each E-shaped core.

14. The transformer of claim 8, wherein a width of each second I-shaped core is greater than that of each third I-shaped core.

15. The transformer of claim 8, wherein each first I-shaped core, each second I-shaped core, each E-shaped core, and each third I-shaped core contain the same magnetic material.

* * * * *